United States Patent [19]

Turner et al.

[11] Patent Number: 4,570,714

[45] Date of Patent: Feb. 18, 1986

[54] GRAVEL PACK ASSEMBLY

[75] Inventors: Dewayne Turner, Breaux Bridge; Raymond A. Menard; Dean Oneal, both of Lafayette, all of La.

[73] Assignee: Geo Vann, Inc., Houston, Tex.

[21] Appl. No.: 564,756

[22] Filed: Dec. 22, 1983

[51] Int. Cl.[4] ..... E21B 43/04

[52] U.S. Cl. ..... 166/278; 166/51; 166/377

[58] Field of Search ..... 166/278, 51, 205, 318, 166/377, 383

[56] References Cited

U.S. PATENT DOCUMENTS

| | | | |
|---|---|---|---|
| 3,126,963 | 3/1964 | Graham | 166/51 |
| 3,134,439 | 5/1964 | Shields, Jr. | 166/51 |
| 3,421,586 | 1/1969 | Solum | 166/51 |
| 3,726,343 | 4/1973 | Davis, Jr. | 166/51 |
| 4,018,284 | 4/1977 | Perkins | 166/178 |
| 4,175,778 | 11/1979 | Nunez et al. | 166/125 |
| 4,424,864 | 1/1984 | Logan | 166/278 |

FOREIGN PATENT DOCUMENTS

| | | | |
|---|---|---|---|
| 649462 | 10/1962 | Canada | 166/51 |

*Primary Examiner*—James A. Leppink
*Assistant Examiner*—Hoang C. Dang
*Attorney, Agent, or Firm*—James R. Duzan; Eugene L. Flanagan, III; David Alan Rose

[57] ABSTRACT

A well apparatus connected to a pipe string extending down into a cased borehole for treating a formation comprising a packer assembly for sealing with the casing assembly and an integral crossover/release assembly attached to the packer assembly for supporting and releasing a gravel screen assembly before or after treating the formation without rotating the pipe string. The crossover/release assembly includes crossover ports providing a downward flow path for the treating fluid, annular veins providing an upward flow path for the returns, and a reciprocating piston reciprocating upon effecting hydraulic pressure on the piston for releasing the gravel screen assembly.

13 Claims, 7 Drawing Figures

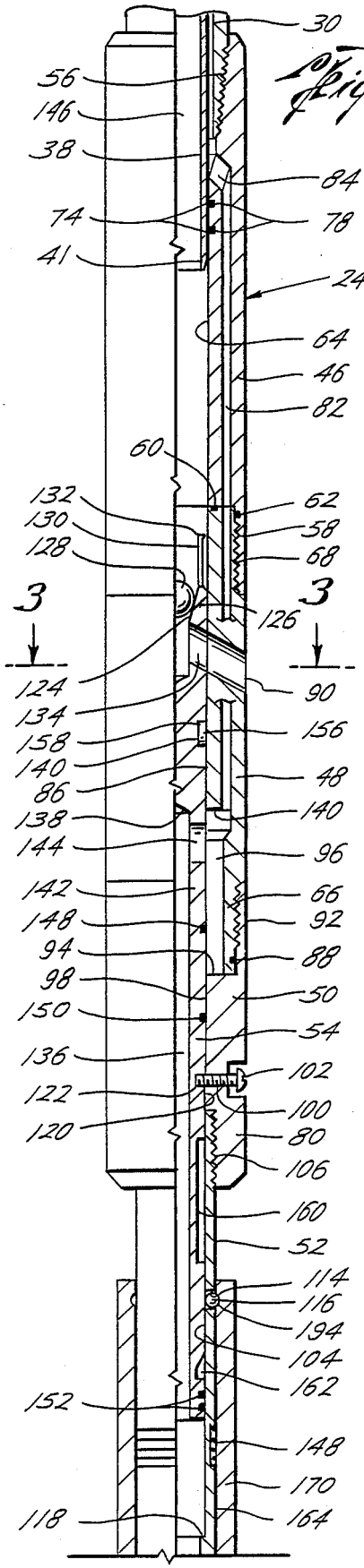
Fig. 2A
Fig. 2B
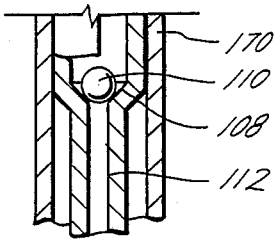
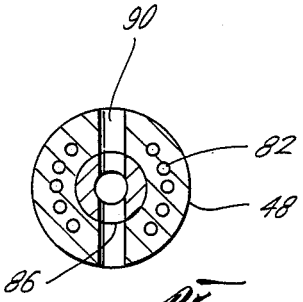
Fig. 3

GRAVEL PACK ASSEMBLY

TECHNICAL FIELD

The present invention relates generally to the field of well completion and, more particularly to the art of sand control. Still more particularly, the present invention includes a gravel pack assembly utilizing a washpipe inside a gravel pack screen and having the gravel pack screen hydraulically released from the work string without rotation of the work string.

BACKGROUND OF THE ART

In oil and gas wells where formation sand is unconsolidated, there is migration of sand particles into the wellbore as fluid is produced. Such migration may cause production loss due to the sand bridging in the casing, the tubing or the flowbore; failure of the casing or the liners; compaction or erosion; abrasion of the downhole or the surface equipment; and handling and disposal of produced formation materials. Therefore, there is a need to prevent such sand migration by either chemical or mechanical means. One method of sand control which is used extensively is that of gravel packing. In general, gravel packing includes the installation of a screen adjacent the formation downhole followed by the packing of gravel in the perforations and around the screen to prevent the sand from migrating from the formation to the production tubing. In such an arrangement, a gravel screen assembly attached to a work string is lowered downhole through an open hole or a cased borehole and adjacent the formation to be completed. A slurry of gravel suspended in a viscous carrier fluid is pumped downhole through the work string and a cross-over assembly into the annulus. Pump pressure is applied to the slurry forcing the suspended gravel through the perforations or up against the formation sand. The gravel then accumulates in the annulus between the screen and the casing or the formation sand. The gravel forms a barrier which allows the flow of hydrocarbons therethrough but inhibits the flow of sand particles into the production tubing which would sand up the well.

There are various methods used in gravel packing operations, the most advantageous being the crossover method. The crossover method, in general, utilizes a standard gravel pack assembly including a gravel screen and a washpipe therewithin. It also utilizes a packer and a crossover assembly at the top of the gravel pack assembly. The packer is set mechanically by rotation of the work string. The packer is located above the crossover assembly and forms a lower borehole annulus adjacent the formation and an upper borehole annulus above the formation. The crossover assembly allows the slurry flowing down the flowbore of the work string above the screen assembly to cross over into the lower borehole annulus below the packer and around the gravel screen adjacent the formation. The gravel is deposited in the formation and lower borehole annulus with the fluid carrier continuing up the washpipe and flowing back through the crossover assembly to the upper annulus above the packer and up to the surface. The advantages of the crossover method are that, by pumping the slurry down the flowbore of the work string, no debris can be scoured from the casing by the slurry and deposited in the perforations to block the perforations to flow; the upper zone perforations or bond casing are subjected to less pressure; the gravel placement time and the chances of sand bridging are reduced; and the fluid and the gravel location are controlled within the work string.

Following the gravel packing operation, it is intended that the work string including a packer and a washpipe assembly be lifted to the surface leaving the gravel pack screen assembly at the bottom of the well. Therefore, a release mechanism is necessary to detach the gravel pack screen assembly from the work string. It is a principal objective that the two are separated without disturbing the completed gravel pack and that the separation does not fail because such failure will cause the destruction of the gravel pack.

Release mechanisms for releasing tools from tool strings downhole in general and, more particularly, for releasing gravel packing assemblies are well known. See for example the releasing assemblies in the gravel pack hardware manufactured by Baker Sand Control, Brown Oil Tools, Dowell and Texas Iron Works disclosed in the 1982–83 *Composite Catalog of Oil Field Equipment and Services* at page 991–992, 1459, 2522 and 7947 respectively. Another releasing tool used in gravel packing operations is disclosed in U.S. Pat. No. 4,175,778. Release tools for releasing tools downhole are disclosed in U.S. Pat. Nos. 2,409,811, 4,187,906, 4,190,107 and 4,289,202.

Most prior art release mechanisms of gravel packing assemblies are activated by rotating the work string. Rotation of the work string is not desirable because it is difficult to implement in slanted and crooked wells; it causes operating problems because of all the auxiliary piping extending from the surface downhole; it requires rotating equipment to rotate the packer, the crossover assembly and the washpipe assembly free from screen and hook-up nipple assembly; and it is unreliable and may not release. Release mechanisms which operate by rotation are shown in the sand control equipment on pages 991–992, 1459, 2522 and 7947 in the aforementioned *Composite Catalog of Oil Field Equipment.*

Prior art release tools that are not activated by rotation are disclosed in U.S. Pat. Nos. 2,409,811 and 4,175,778. The release tool disclosed in U.S. Pat. No. 2,409,811 is not specifically related to gravel packing operations, but to downhole releasing tools in general. It includes a plurality of balls partly positioned within holes in the retaining member and within apertures in the retained member, thereby locking both members together. The balls are kept in that locking position by a piston which is in intimate contact with the retaining member. If the piston is displaced, the intimate contact is eliminated and the balls move away from the apertures of the retained member whereby the connection between the two members is unlocked and the retaining member may be removed from the retained member. The piston, which has an internal passageway in series with the flowbore of the work string, is displaced by applying hydraulic pressure on it through the flowbore of the work string after the passageway is closed by a steel ball. The hydraulic pressure is not relieved by the displacement of the piston alone, but by the relative displacement of the retaining and retained members.

The tool disclosed in U.S. Pat. No. 4,175,778 is used to release gravel packing screens and discloses a plurality of blocks with chamfered surfaces partly positioned within holes in the retaining member and partly positioned within an annular groove in the hook-up nipple of the gravel packing screen thereby locking the two together. The blocks are held in that position by the interior surface of the piston which is in intimate contact with the interior of the retaining member adjacent the apertures. In order to release the hook-up nipple and the gravel packing assembly, the piston, which has an internal passageway in series with the flowbore of the tubing string, is displaced by closing the passageway with a steel ball and applying hydraulic pressure on it from the flowbore of the work string. When the piston is displaced, the blocks are no longer held in the locked position and the hook-up nipple is released. The hydraulic pressure is relieved by the displacement of the piston which exposes a relief port to the annulus.

One disadvantage of the release tools, which do not use rotation and which are disclosed in U.S. Pat. Nos. 2,409,811 and 4,175,778, is that they are not integral with the crossover assembly. This is also a disadvantage of some of the rotational releasing tools such as one of the tools shown on page 991 of the aforementioned Catalog.

Another disadvantage of the prior art, is that the release assembly cannot be activated until after the gravel packing operation is completed. Therefore, it is often necessary to repeat the time consuming and costly gravel packing operation because the release mechanism fails and such failure is not detected until the gravel packing operation has been performed. For this reason, there is a need for a release device which can release the gravel pack assembly before gravel packing commences so that any failure may be detected before valuable time and money is expended. The prior art cited above discloses release tools which release the gravel pack assembly after the operation is completed.

Some prior art release tools release the gravel pack screen together with the packer used in the operation and do not provide for the release of the gravel screen only. Therefore, an operator is often limited to using the packer for the gravel pack operation as the production packer. The Baker Sand Control, Brown Oil Tool, Dowell and Texas Iron Works Tools shown in the 1982–83 Composite Catalog of Oil Field Equipment and Services at pages 992, 1459, 2522 and 7947 are limiting in that respect.

The present invention overcomes the present deficiency of the prior art.

SUMMARY OF THE INVENTION

The method and apparatus of the present invention includes a gravel pack assembly which is suspended from a work string extending from the surface to a payzone located downhole. The gravel pack assembly is suspended approximately one and a half feet above the bottom of the borehole. The gravel pack assembly includes a packer assembly, a retrievable circulating hydraulic release assembly, and a gravel screen assembly. The packer assembly includes a packer for sealing engagement with the casing and an inner mandrel disposed within the packer. The mandrel forms a annular flow passageway with the packer to provide fluid communication between the upper casing annulus and the retrievable circulating hydraulic release assembly connected thereunder.

The retrievable circulation hydraulic release assembly includes a cylindrical body with a stinger extending downwardly from its lower end, and a release piston reciprocably disposed within the body. The piston blocks fluid flow through the flow bore of the body. Slurry ports are provided through the side wall of the body above the piston to provide fluid communication between the upper flow bore of the body and the lower borehole casing annulus below the packer. Vertical veins, not in communication with the slurry ports, provide fluid communication around the piston whereby fluid may flow from the mandrel flow passageway to the flowbore of the stinger below the piston.

The gravel screen assembly includes a nipple supporting a gravel screen, a tell-tale screen disposed between two o-ring subs, and a bull plug. The nipple telescopingly receives the polished stinger of the release assembly and is connected thereto by detent balls projecting through apertures in the stinger and into engagement with an annular groove in the nipple. The detent balls are biased into the annular groove by the piston.

The release piston is held by shear screws in the engaged position. The lower end of the stinger forms a washpipe which sealingly engages the o-ring subs on the lower end of the gravel screen to prevent fluid communication between the flowbore of the washpipe and the exterior of the screen.

To disconnect the gravel screen assembly from the release assembly, a sphere is pumped down the work string and seated onto the upper end of the piston so as to close the slurry ports through the body of the release assembly. By pressuring down the work string, the shear screw holding the piston in place is sheared permitting the piston to move downwardly thereby releasing the detent balls into an annular relief recess in the piston. In the disengaged position, the slurry ports are again open to provide fluid communication between the flowbore of the work string and the lower borehole casing annulus. Further, the washpipe is open to fluid flow from the exterior of the screen as the screen drops down after disengagement. The gravel screen assembly is now disconnected from the release assembly for the gravel pack operation and drops to the bottom of the hole. The stinger remains sealingly enjoined with the hook-up nipple of the gravel screen assembly.

The gravel pack operation is then performed by pumping a slurry of gravel and carrier fluid down the work string flowbore, through the slurry ports, and into the lower borehole casing annulus. Gravel is then forced into the perforations and into the lower borehole filling the lower borehole annulus. The carrier fluid is returned to the surface through the screen, washpipe, vertical veins and upper borehole casing annulus. When the gravel packing operation is completed, the packer is released followed by reverse circulation to remove excess gravel. The packer assembly and release assembly with washpipe are then raised and removed from the well, leaving the gravel screen assembly downhole.

These and various other objects and advantages of the present invention will become readily apparent to those skilled in the art upon reading the following detailed description and claims and by referring to the accompanying drawings.

The above objects are attained in accordance with the present invention by the provision of a method of gravel packing a well and for use with apparatus fabricated in a manner substantially as described in the above abstract and summary.

BRIEF DESCRIPTION OF THE DRAWINGS

For a detailed description of the preferred embodiments of the apparatus and method of the present invention, reference will now be made to the accompanying drawings wherein:

FIGS. 2A and 2B are an enlarged cross-sectional view of the release assembly of the gravel pack apparatus shown in FIGS. 1A and 1B;

FIG. 3 is a cross-sectional view taken along the plane shown by line 3—3 in FIG. 2A.

DESCRIPTION OF PREFERRED EMBODIMENTS

Figure 1A:
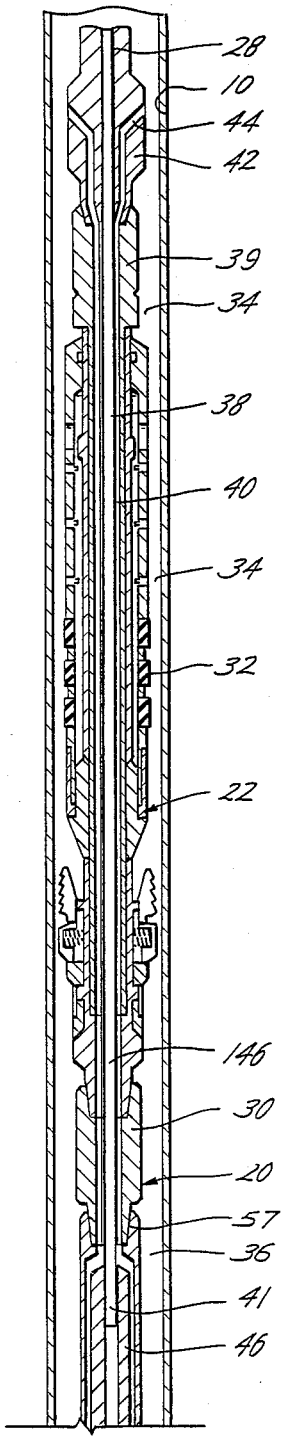
FIGS. 1A and 1B are a cross-sectional elevation view of the gravel pack assembly of the present invention disposed in a cased borehole adjacent the formation to be completed.
Figure 1B:
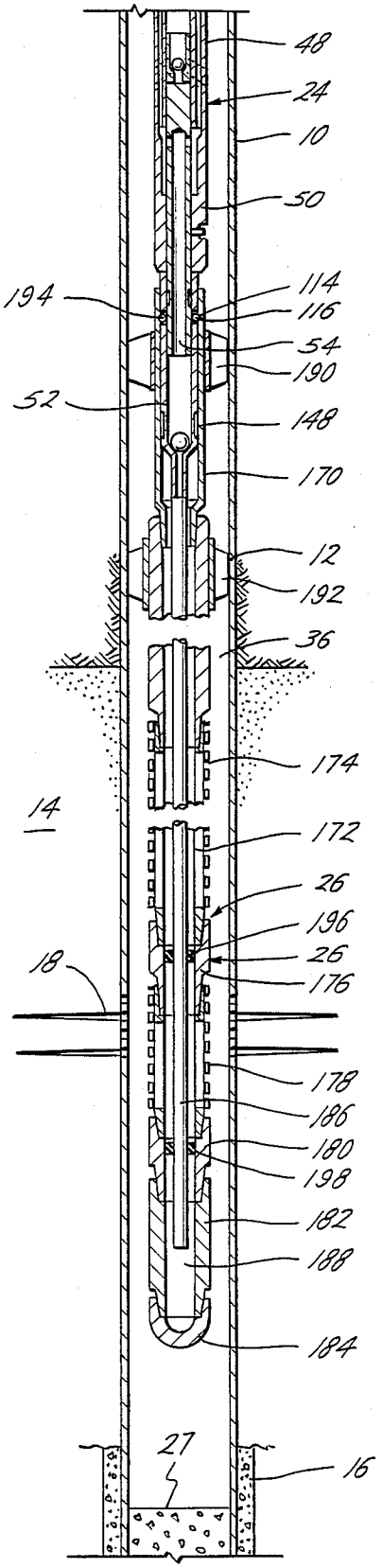

Referring initially to FIGS. 1A and 1B showing a typical application of the present invention, there is illustrated a cased borehole 10 having a casing 12 extending through an unconsolidated formation or payzone 14 prior to the gravel packing operation. Casing 12 is cemented into borehole 10 as shown at 16. Casing 12, cement 16 and payzone 14 have been perforated as at 18 to provide flow communication between the flowbore of casing 12 and payzone 14 for the flow of hydrocarbons from payzone 14 to the production tubing (not shown) when production commences.

In accordance with the procedure of the present invention, a gravel pack assembly 20 is lowered into the cased borehole 10 on a work string 28 until assembly 20 is a predetermined distance, such as approximately one to one and a half feet, above the preferred location of assembly 20 with respect to the perforated payzone 14 for the gravel pack operation. Although gravel pack assembly 20 is shown in FIG. 1 approximately one and a half feet above the cement bottom 27 of cased borehole 10, a bridge plug (not shown) may be used as borehole bottom 27 for properly locating and operating gravel pack assembly 20.

Gravel pack assembly 20 includes a packer assembly 22, a retrievable circulating hydraulic release assembly 24 and a gravel screen assembly 26.

The packer assembly 22 is connected to the work string 28 which extends to the surface (not shown) and includes an upper ported sub 42, an upper joint 39, a packer liner mandrel 38, a packer 32, and a lower pup joint 30. Packer 32 may be a retrievable packer, such as an R-type retrievable casing packer, well known in the art, and no further description of its assembly or operation will be provided. Packer 32 is provided for sealing engagement with casing 12 to form an upper casing annulus 34 and a lower casing annulus 36, best shown in FIG. 4A. The pack-off or packer elements of packer 32 is disposed around packer liner mandrel 38 and between joint 39, at the upper end of mandrel 38, and lower pup joint 30. Mandrel 38 extends downwardly through pup joint 30 and is received by release assembly 24 as hereinafter described.

An annular fluid passageway 40 is formed between packer liner mandrel 38 and packer 32 and extends from the interior of pup joint 30 to radial ports 44 in ported sub 42 thereby providing fluid communication between upper casing annulus 34 and the lower end of pup joint 30. Fluid passageway 40 and ports 44 permit a fluid bypass around packer 32 in its actuated position shown in FIG. 4A whereby fluid flow can be provided between the surface, via upper casing annulus 34, and retrievable circulating hydraulic release assembly 22 and gravel screen assembly 26 disposed below packer 32.

Referring now to FIGS. 1A, 1B, 2A, and 2B showing retrievable circulating hydraulic release assembly 24, assembly 24 includes an upper connecting sub 46, an intermediate crossover sub 48, a lower sub 50, a polished stinger 52 and an inner release piston 54.

Upper connecting sub 46 includes a cylindrical body having a cylindrical bore 64 therethrough and a threaded box 56 mating with the threaded pin end 57 of pup joint 30 shown in FIG. 1A. Bore 64 of sub 46 receives the lower end portion 41 of packer liner mandrel 38 with O-ring seals 74 disposed in annular grooves 78 for sealing engagement with mandrel end portion 41. A threaded box 58 is provided on the lower end of sub 46 for threadingly receiving the matingly threaded pin end 68 of crossover sub 48.

Crossover sub 48 also has a cylindrical body with pin end 68 at its upper end and a threaded pin end 66 at its lower end. The body of sub 48 includes a common bore 86 of the same diameter as bore 64 of connecting sub 46. An enlarged diameter portion of sub 48, adjacent lower pin end 66, forms a lower annular chamber 96.

A plurality of coaxial fluid veins 82 extend vertically through the walls of connecting sub 46 and crossover sub 48. Inner and outer seals 60, 62 are provided at the connection of subs 46, 48 to seal the flow path of veins 82 therethrough. Alignment of fluid veins 82 at the connection of subs 46, 48 is provided by a shoulder to shoulder connection with O-ring sealing backups. The upper ends of veins 82 communicate with an upper annular chamber 84 in connecting sub 46 which extends radially from the upper ends of veins 82 to the interior of connecting sub 46. Packer liner mandrel 38 extends beyond annular chamber 84 in sub 46, with seals 74 disposed below chamber 84, to provide fluid communication between chamber 84 and fluid passageway 40. Thus veins 82 are in fluid communication with the surface. The lower ends of veins 82 communicate with lower annular chamber 96 in crossover sub 48.

Referring now to FIGS. 2A and 3, crossover sub 48 further includes one or more slurry ports 90 providing fluid communication between bore 86 and lower casing annulus 36. Slurry ports 90 are not in fluid communication with veins 82 since ports 90 are not in the same plane as shown in FIG. 3.

Referring again to FIGS. 2A and 2B, lower sub 50 includes a cylindrical body having an upper threaded box 92 receiving and threadingly engaging the lower pin 66 of crossover sub 48. An O-ring seal 88 is disposed in an annular groove in box 92 for sealing the connection between subs 48 and 50. Box 92 forms an upwardly facing shoulder 94 forming one side of annular chamber 96. Sub 50 has a bore 98 with a diameter common to that of bores 64, 86 of subs 46, 48 respectively.

A lower threaded box end 80 is provided for connection with polished stinger 52. Lower sub 50 also includes a radial bore 100 extending through the wall thereof for housing a shear screw 102 for positioning piston 54 as hereinafter described.

Polished stinger 52 disposed on the lower end of sub 50 includes a cylindrical element having a bore 104 with a diameter equal to the diameter of bores 64, 86, 98. The upper exterior end of stinger 52 is threaded at 106 for threaded engagement with the lower box end 80 of sub 50. The upper end of stinger 52 abuts a lower shoulder formed by box end 80 of sub 50. The cylindrical element of stinger 52 includes a reduced diameter portion 112 above its lower end to form an upwardly facing conical portion or valve seat 108 adapted to receive and seal with a ball valve 110. The lower end of stinger 52 extends downwardly into and is telescopically received by gravel screen assembly 26. Stinger 52 also includes a plurality of apertures 114 extending through the wall of stinger 52 for receiving detent balls 116, and an inwardly projecting annular shoulder 118. The purpose of detent balls 116 and shoulder 118 will be hereinafter described.

Internal release piston 54 has an outer cylindrical surface 120 for the sliding reception of piston 54 within crossover sub 48, lower sub 50 and stinger 52. Piston 54 is held in position by shear screw 102 mounted in lower sub 50 and projecting into a blind bore 122 in the outer surface 120 of piston 54. A cavity 124 is provided in the upper end of piston 54 forming an upwardly facing conical actuator seat 126 for receiving an actuator sphere 128. A plurality of spring fingers 130 project upwardly from piston 54 and have radially directed flanges 132 for providing a latching engagement with a fishing tool (not shown).

Slurry ports 134 are provided in the upper end of piston 54 which extend from cavity 124 to the outer surface 120. In the engaged position shown in FIGS. 1A, 1B, 2A and 2B with shear screw 102 in place, slurry ports 134 of piston 54 are in alignment with slurry ports 90 of crossover sub 48.

Piston 54 includes a solid rod-like upper body portion or plug 140 disposed below cavity 124 and a lower cylindrical body portion 142 forming a downwardly extending blind bore 136 with a downwardly facing bottom end 138. The upper body portion or plug 140 of piston 54 blocks and prevents fluid flow through bore 86 of crossover sub 48. Circulation ports 144 are provided through the cylindrical walls of lower body portion 142 near bore bottom 138 for providing fluid communication between blind bore 136 of piston 54 and annular chamber 96 of crossover sub 48. Thus, upper body portion 140 directs flow down the flowbore 146 of mandrel 38 and bore 64 of connecting sub 46 through slurry ports 134 and 90 into lower borehole annulus 36 and directs flow up the gravel pack assembly 26 and bore 136 of piston 54 through circulation ports 144 and up veins 82 to the surface via upper casing annulus 34. Upper O-ring seals 148, 150 are disposed in the periphery of lower cylindrical body portion 142 for sealingly engaging lower sub 50, O-ring seal 148 becoming sealingly engaged in the non-engaged position of piston 54. Lower O-ring seals 152 are provided in the periphery adjacent the lower end of cylindrical body portion 152 for sealing engagement with stinger 52.

A snap ring 156 is provided in an annular groove 158 located below slurry ports 134 in the external periphery of piston 54 for engagement with the downwardly facing annular shoulder 140 on crossover sub 48, forming the upper side of lower chamber 96, when piston 54 is in the lower non-engaged position hereinafter described in further detail.

That portion of the lower cylinder body portion 142 of piston 54 received within stinger 52 includes an annular relief recess 160 which is disposed above apertures 114 and detent balls 116 in the engaged position of piston 54, and an annular notch 162 disposed below apertures 114 for housing detent balls 116 during the assembly of release assembly 24. That portion of body portion 142 between notch 162 and recess 160 provides a biasing means for biasing detent balls 116 in the attached position, hereinafter described, for connecting release assembly 24 to gravel screen assembly 26.

When the retrievable release assembly 24 is lowered into the well for gravel packing, piston 54 is intimately disposed within bores 86, 98, and 104 formed by crossover sub 48, lower sub 50 and polished stinger 52, respectively, in the unreleased or engaged position as shown in FIGS. 1A, 1B, 2A and 2B. It is retained there by shear screw 102 which is disposed in radially aligned bores 100 and 122. In that position, slurry ports 134 are aligned with slurry ports 90; circulating ports 144 are aligned with annular chamber 96; and annular relief recess 160 and annular notch 162 are respectively above and below apertures 114 whereby detent balls 116 are maintained in a position extending beyond outer surface 164 of polished stinger 52 and into groove 194 of hook-up nipple 170. Also, in the unreleased or engaged piston position, the outer cylindrical surface of plug 140 is in intimate contact with bore 86 of crossover sub 48 whereby snap rings 156 are retained within grooves 158. O-ring seal 150 provides a sealing engagement between piston 54 and lower sub 50 thereby preventing the leak of any fluids from annular chamber 96 through apertures 114. Also O-ring seals 152 provide a sealing engagement between piston 54 and stinger 52 preventing leaks from bore 112 through apertures 114.

As shown in FIG. 1B, hook-up nipple 170 and blank pipe 172 have centralizers 190, 192, respectively, mounted thereon to centrally locate the gravel screen assembly 26 within lower casing annulus 36 to facilitate the gravel pack operation. Further, it can be seen that nipple 170 telescopingly receives a substantial portion of stinger 52 and is mounted thereon by detent balls 116 radially projecting through apertures 114 and into an annular groove 194 in the inner periphery of hook-up nipple 170.

Upper and lower O-ring subs 176, 180 include O-rings 196, 198, respectively, for sealingly engaging the outer surface of polished end of washpipe 186. With subs 176 and 180 being disposed above and below tell-tale screen 178, fluid flow through screen 178 is effectively blocked.

Referring still to FIG. 1B, the gravel screen assembly 26 includes a hook-up nipple 170, a blank pipe 172, one or more main screens 174, an upper O-ring sub 176, a tell-tale screen 178, a lower O-ring sub 180, an extension sub 182, and a bull plug 184. Washpipe 186 extends through the bore 188 formed by nipple 170, pipe 172, screen 174, sub 176, screen 178, sub 180, and extension sub 182. Washpipe 186 is connected to the lower end of stinger 52 or is integral therewith and extends downwardly into extension sub 182. Tell-tale screen 178, as is well known in the art, permit the flow therethrough of the carrier fluid for the gravel slurry and main screen 174 permits the flow of production fluids from the formation 14 after gravel packing.

In operation, the gravel pack assembly 20 is lowered into the well on work string 28 until bull plug 184 tags bottom 27 set at a predetermined depth. After tagging bottom 27, the gravel pack assembly 20 is raised so that bull plug 184 is approximately one to one and a half feet above bottom 27 as shown in FIGS. 1A and 1B. Fluid is then pumped from the surface down the flowbore of work string 28 and flowbore 146 of packer liner mandrel 38. The fluid continues to flow through bore 64 of connecting sub 46 and through slurry ports 134, 90 and into the lower borehole annulus. The immediately preceding flow path may be called the "downward flow path." The circulating fluid then returns up upper casing annulus 34 to the surface to remove any debris present in its path. The packer 32 has not yet been set.

Figure 4A:
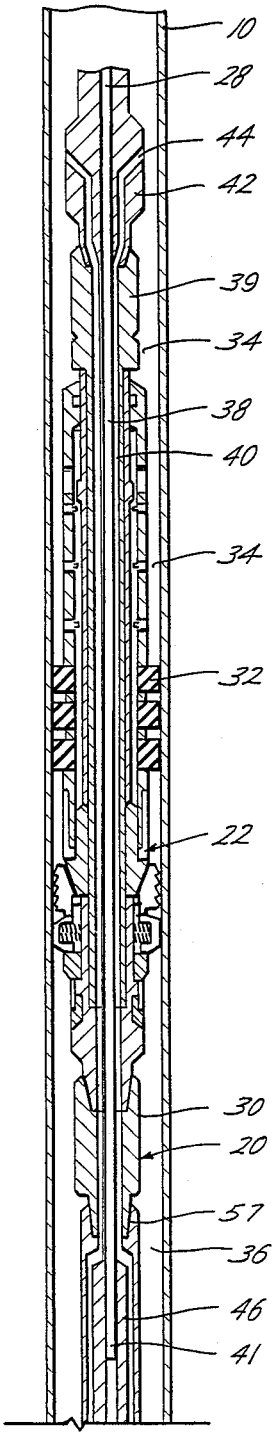
FIGS. 4A and 4B are a cross-sectional view of the gravel pack assembly and the release assembly of FIGS. 1A and 1B after the gravel screen assembly is released.
Figure 4B:
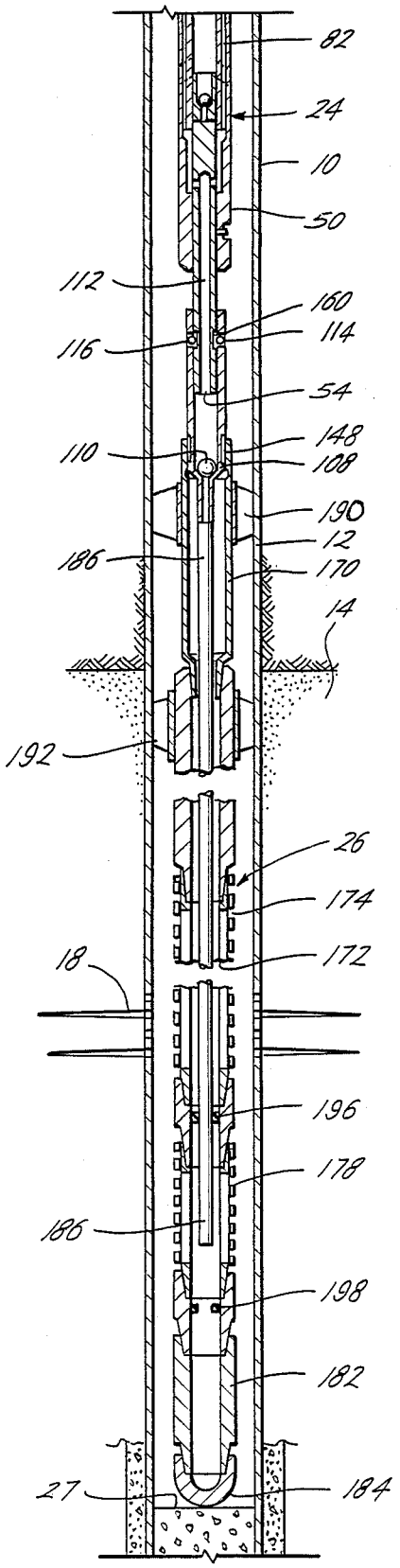

Referring now to FIGS. 4A and 4B, following circulation for the removal of debris, packer 32 is set to sealingly engage casing 12 and form upper and lower annulus 34, 36. Packer 32 is then tested by pressuring fluid down upper casing annulus 34 with ball valve 110 closed. If packer 32 is not set properly for sealing engagement with casing 12, fluid will flow around packer 32 into lower casing annulus 36. The leaking fluid will return to the surface via slurry ports 90, 134, shown in FIG. 2A, and up the flowbores of mandrel 38 and work string 28, signaling to the operator that packer 32 has failed. If no leak is detected within the flowbore of work string 28, the implication is that packer 32 has set properly and the remaining steps of the operation are carried out.

In testing packer 32, ball valve 110 is closed and prevents fluid flow into that portion of the flowbore of washpipe 186 located below valve 110. This is accomplished automatically in testing packer 32 because, as pressure is applied down upper casing annulus 34, the fluid pressure is displaced down flow passageway 40, veins 82, and into that portion of flowbore 112 above sphere 110 to hold sphere 110 in sealing relationship with valve seat 108. This arrangement allows the operator to retest the packer in any stage of the gravel packing operation i.e. whether tell-tale screen 178 is open or not.

Following packer testing, a pressure squeeze acidizing operation may be performed. Acid stimulation may provide dramatic improvement in the production of payzone 14. Therefore, in many instances it is desirable to inject acid in the perforations and the permeability system of the formation. This is done by pressuring acid downhole into the formation. In the instant case, acid is pumped down the downward flow path and into lower casing annulus 36 adjacent payzone 14. Because the return path to the surface through upper casing annulus 34 is closed by packer 32 and washpipe 186, the acid penetrates the formation to a great extent and removes debris and any other inhibitors thereby enhancing the production from payzone 14. Following the acid squeeze, the remaining fluid is pumped out of the system and the well is ready for gravel packing. It is desired that the acidizing operation be carried out with washpipe 186 blocking tell-tale screen 178 and therefore, before releasing gravel screen assembly 20 so that casing 12 in upper annulus 34 is not exposed to the high pressure present in the acid squeeze operation.

In the present invention, main screen 174 and its accessories, including hook-up nipple 170, blank pipe 172, tell-tale screen 178, subs 176, 180, 182 and bull plug 184, are released from the release assembly 24 before the gravel packing operation is commenced. In other release tools the screen is released after the gravel packing operation is completed. This often presents a significant problem because release mechanisms fail for numerous reasons, thereby forcing the operator to raise the gravel pack screen and destroy the completed gravel pack. With the present invention, the operator is assured, before the time consuming and costly gravel packing operation is commenced, that the release mechanism has not failed and that he will not have to repeat the operation.

The retrievable circulating hydraulic release assembly 24 is activated by dropping or pumping a steel ball 128 down the flowbore of work string 28 to land on ball seat 126. The flowbore of work string 28 is then filled with liquids and additional pump pressure is applied from the surface to actuate piston 54. Steel ball 128 and ball seat 126 are intimately engaged and prevent the flow of fluids out of the flowbore of work string 28 via slurry ports 134, 90. Therefore, fluid pressure may be applied to internal release piston 54. When the pressure exceeds a predetermined amount, shear screw 102 shears and piston 54 is displaced downwardly until it engages shoulder 118. As piston 54 moves downwardly, annular relief recess 160 becomes adjacent to and aligned with apertures 114 and the intimate biasing contact between piston 54 and detent balls 116 disposed in apertures 114, is terminated. Detent balls 116 are biased inwardly by the weight of the gravel pack assembly 26, and balls 116 move into annular relief recess 160, thereby releasing hook-up nipple 170 and permitting the gravel screen assembly 26 to slide downwardly until bull plug 184 hits bottom 27. As gravel screen assembly 26 moved downwardly, washpipe 186 remained stationary whereby seal 198 of lower O-ring sub 180 sealingly disengaged washpipe 186 to open tell-tale screen 178 to fluid flow.

FIGS. 4A and 4B show the environment of the present invention and retrievable circulating hydraulic release assembly 24, after release assembly 24 has been activated and has released gravel screen assembly 26. The downward displacement of piston 54 to shoulder 118, shown in FIG. 2A, has caused, as previously explained, annular relief recess 160 to move adjacent apertures 114, detent balls 116 to be displaced towards relief recess 160 and hook-up nipple 170 and its attachments to slide downwards and hit bottom 27 through bull plug 184. In this position, hook-up nipple 170 has moved below apertures 114. However, it is still in a sealing engagement with polished stinger 52 via rolling seals 148 because stinger 52 has sufficient length, i.e. over one to one and half feet, projecting into hook-up nipple 170 to maintain the sealing engagement with sealing means 148. Then the upper portion of piston 54, including ball seat 126, and steel ball 128 seated thereon, have moved below slurry ports 134, 90 whereby fluid communication is again established between the flowbore of work string 28 and lower casing annulus 36. Also, even though it is in a lower position, circulating port 144 remains adjacent and in fluid communication with annular chamber 96. Because seal 150 has been displaced to a lower location, it no longer provides sealing between piston 54 and that portion of bore 98 which is above bore 112. Sealing for these two surfaces is now provided by seal 148. In the unreleased position, seal 148 was adjacent annular chamber 96 and therefore, it was not in a sealing engagement with any surface. Furthermore, in the released position, annular grooves 158 have moved adjacent annular chamber 96 causing snap rings 156 to engage shoulder 140 thereby preventing a premature upward displacement of piston 54.

Following the release of gravel screen assembly 26, the gravel packing operation commences. Referring again to FIGS. 4A and 4B, carrier fluid containing gravel is pumped down the downward flow path. The fluid with the suspended solids enters the flowbore of work string 28 and flows to lower casing annulus 36 and through slurry ports 134, 90, shown in FIG. 2A, and down lower casing annulus 36 where the gravel is forced into perforations 18 and begins to accumulate starting from the bottom and progressing towards the top. The solid free carrier fluid continues its flow through tell-tale screen 178, washpipe 186, valve 108, bore 112, circulating ports 144, annular chamber 96, veins 82, chamber 84, flow passageway 40, port 44 and up through upper casing annulus 34 to the surface. This flow path may be called the "upward flow path." Once the gravel level is above tell-tale screen 178, a gravel pressure squeeze operation may be performed to force the gravel into perforation 18 and to increase the packing density. If the pressure resistance by the gravel accumulated around tell-tale screen 178 is not adequate for the pressure squeeze operation, the return of the carrier fluid to the surface through upper casing annulus 34 may be closed by closing the rams in the blow out preventer at the surface, whereby the pressure resistance is increased. When the gravel level in lower casing annulus 36 reaches a certain point above screen 174, the slurry circulation is discontinued. Packer 32 is then unset followed by reverse circulation of fluid down upper casing annulus 34, lower casing annulus 36, slurry ports 134, 90 and up the flowbore of work string 28 to remove excess gravel. Following reverse circulation, the gravel packing operation is completed and the gravel pack assembly including work string 28, packer assembly 22 and retrievable circulating hydraulic release assembly 24 with the attached valve seat 108, sphere 110 and washpipe 186 is raised and removed from the well. Screen 174 and its attachments hook-up nipple 170, blank pipe 172, subs 176, 180, 182, tell-tale screen 178 and bull plug 184 remain downhole with the packed gravel. The well may then be completed and production may be commenced immediately.

Another embodiment of the present invention is identical to the embodiment described above except in that it does not include an O-ring 198, an O-ring sub 180 and a portion of washpipe 186 blocking tell-tale screen 178 before gravel pack assembly 20 is released. In this embodiment gravel screen assembly 20 may be released either before or after the gravel packing operation and it is not necessary that gravel screen assembly 20 be raised after bull plug 184 tags bottom 27 at the commencement of the operation. In general, because washpipe 186 does not block tell-tale screen 178, this embodiment may not be used when acidizing operation is required. However, if casing 12 in upper annulus 34 is relatively new and can withstand high pressure, acidizing may be performed with this embodiment by closing the rams in the blow out preventer at the surface to provide the required pressure resistance for the acidizing operation.

While preferred embodiments of the invention have been shown and described, modifications thereof can be made by one skilled in the art without departing from the spirit of the invention.

What is claimed is:

1. A crossover/release assembly for a screen assembly to treat a formation, comprising:

a tubular body having an axial flow bore therethrough and a lower end telescopingly received within the screen assembly;

a sliding piston disposed within said tubular body having an upper portion closing said flow bore to fluid flow and a lower tubular portion extending into said screen assembly;

a first fluid communication means through said upper piston portion and tubular body providing fluid communication between said flow bore and the exterior of said tubular body;

a second fluid communication means through the walls of said tubular body and said lower tubular piston portion providing fluid communication around said upper piston portion; and said sliding piston reciprocating between a first position connecting said tubular body with the screen assembly and a second position releasing the screen assembly from said tubular body.

2. The crossover/release assembly according to claim 1 wherein said lower end has apertures housing projecting members, said lower tubular piston portion biasing said projecting members against the screen assembly in said first position.

3. The crossover/release assembly according to claim 2 wherein said lower tubular piston portion has relief means for releasing the biasing of said projecting members against the screen assembly in said second position.

4. The well apparatus according to claim 3 wherein said first fluid communication means includes a first port in said piston aligned with a second port in said body in said first position.

5. The well apparatus according to claim 3 wherein said second fluid communication means includes annular veins communicating with an annular chamber in said body and a third port in said piston aligned with said annular chamber.

6. The well apparatus according to claim 1 further including shear means holding said sliding piston in said first position.

7. The well apparatus according to claim 1 further including lockdown means for locking said piston in said second position.

8. The well apparatus according to claim 1 wherein said piston includes latch means for latching a tool to said piston to reciprocate same.

9. The well apparatus according to claim 1 further including means for closing said first fluid communication means to effect fluid pressure on said sliding piston and move said piston to said second position.

10. The method of gravel packing a well comprising the steps of:

supporting a gravel pack screen from a pipe string extending to the surface;

disposing of the gravel pack screen adjacent a formation at a predetermined distance above the bottom of the borehole;

setting a packer;

forming a downward flow path from the surface to the lower borehole annulus below the packer;

forming an upward flow path from the lower borehole annulus to the surface;

releasing the gravel pack screen, said releasing step including:

closing the downward flow path above the gravel pack screen; and effecting fluid pressure down the downward flow path to release the gravel pack screen;

dropping the gravel pack screen to the bottom of the borehole and thereafter;

circulating a gravel slurry through the downward flow path;

circulating the returns through the upward flow path; and removing the pipe string from the well.

11. The method of claim 10 further including following the step of setting the packer, the step of testing the packer.

12. The method of claim 10 further including prior to the step of releasing the gravel pack screen, the step of acidizing the well.

13. the method of claim 12 wherein the step of acidizing the well includes the step of closing the upward flow path.

* * * * *